US008844651B2

(12) United States Patent
Fripp et al.

(10) Patent No.: US 8,844,651 B2
(45) Date of Patent: Sep. 30, 2014

(54) THREE DIMENSIONAL FLUIDIC JET CONTROL

(75) Inventors: Michael L. Fripp, Carrollton, TX (US); Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 613 days.

(21) Appl. No.: 13/187,821

(22) Filed: Jul. 21, 2011

(65) Prior Publication Data

US 2013/0020090 A1 Jan. 24, 2013

(51) Int. Cl.
*E21B 10/61* (2006.01)
*E21B 7/18* (2006.01)
*E21B 41/00* (2006.01)

(52) U.S. Cl.
CPC ..... *E21B 10/61* (2013.01); *E21B 41/0078* (2013.01)
USPC ..... 175/67; 166/297; 166/222; 166/223

(58) Field of Classification Search
CPC ..... E21B 7/18; B05B 1/08
USPC ..... 166/222, 223, 297; 175/67; 239/589.1
See application file for complete search history.

(56) References Cited

U.S. PATENT DOCUMENTS

| | | | | |
|---|---|---|---|---|
| 2,324,819 | A | 6/1941 | Butzbach | |
| 3,405,770 | A | 10/1968 | Galle et al. | |
| 3,441,094 | A | 4/1969 | Galle et al. | |
| 3,610,347 | A | 10/1971 | Diamantides et al. | |
| 3,730,269 | A | 5/1973 | Galle | |
| 3,850,135 | A | 11/1974 | Galle | |
| 4,630,689 | A | 12/1986 | Galle et al. | |
| 4,687,066 | A * | 8/1987 | Evans | 175/340 |
| 4,775,016 | A | 10/1988 | Barnard | |
| 4,919,204 | A | 4/1990 | Baker et al. | |
| RE33,605 | E * | 6/1991 | Bauer | 239/589.1 |

(Continued)

FOREIGN PATENT DOCUMENTS

| | | | |
|---|---|---|---|
| EP | 0834342 | A2 | 4/1998 |
| EP | 1857633 | A2 | 11/2007 |

(Continued)

OTHER PUBLICATIONS

Summers, David A.; Lehnhoff, Terry F.; "Water Jet Drilling in Sandstone and Granite", conference paper for the 18th U.S. Symposium on Rock Mechanics (USRMS), dated Jun. 22-24, 1977, 5 pages.

(Continued)

*Primary Examiner* — William P Neuder
*Assistant Examiner* — Richard Alker
(74) *Attorney, Agent, or Firm* — Smith IP Services, P.C.

(57) ABSTRACT

A method of controlling a fluid jet can include discharging fluid through an outlet of a jetting device, thereby causing the fluid jet to be flowed in multiple non-coplanar directions, and the fluid jet being directed in the non-coplanar directions by a fluidic circuit of the jetting device. A jetting device can include a body having at least one outlet, and a fluidic circuit which directs a fluid jet to flow from the outlet in multiple non-coplanar directions without rotation of the outlet. A method of drilling a wellbore can include flowing fluid through a fluidic switch of a jetting device, thereby causing a fluid jet to be discharged in multiple non-coplanar directions from the jetting device, and the fluid jet cutting into an earth formation.

29 Claims, 8 Drawing Sheets

(56) References Cited

U.S. PATENT DOCUMENTS

| | | | | |
|---|---|---|---|---|
| 5,135,051 | A | 8/1992 | Facteau et al. | |
| 5,165,438 | A | 11/1992 | Facteau et al. | |
| 5,184,678 | A | 2/1993 | Pechkov et al. | |
| 5,230,389 | A | 7/1993 | Besson | |
| 5,484,016 | A | 1/1996 | Surjaatmadja et al. | |
| 5,533,571 | A | 7/1996 | Surjaatmadja et al. | |
| 5,603,378 | A * | 2/1997 | Alford | 166/222 |
| 5,893,383 | A | 4/1999 | Facteau | |
| 6,015,011 | A | 1/2000 | Hunter | |
| 6,241,019 | B1 | 6/2001 | Davidson et al. | |
| 6,336,502 | B1 | 1/2002 | Surjaatmadja et al. | |
| 6,367,547 | B1 | 4/2002 | Towers et al. | |
| 6,371,210 | B1 | 4/2002 | Bode et al. | |
| 6,405,797 | B2 | 6/2002 | Davidson et al. | |
| 6,470,980 | B1 | 10/2002 | Dodd | |
| 6,619,394 | B2 | 9/2003 | Soliman et al. | |
| 6,622,794 | B2 | 9/2003 | Zisk, Jr. | |
| 6,627,081 | B1 | 9/2003 | Hilditch et al. | |
| 6,644,412 | B2 | 11/2003 | Bode et al. | |
| 6,668,948 | B2 * | 12/2003 | Buckman et al. | 175/67 |
| 6,691,781 | B2 | 2/2004 | Grant et al. | |
| 6,719,048 | B1 | 4/2004 | Ramos et al. | |
| 6,851,473 | B2 | 2/2005 | Davidson | |
| 6,976,507 | B1 | 12/2005 | Webb et al. | |
| 7,025,134 | B2 | 4/2006 | Byrd et al. | |
| 7,114,560 | B2 | 10/2006 | Nguyen et al. | |
| 7,185,706 | B2 | 3/2007 | Freyer | |
| 7,213,650 | B2 | 5/2007 | Lehman et al. | |
| 7,213,681 | B2 | 5/2007 | Birchak et al. | |
| 7,216,738 | B2 | 5/2007 | Birchak et al. | |
| 7,290,606 | B2 | 11/2007 | Coronado et al. | |
| 7,318,471 | B2 | 1/2008 | Rodney et al. | |
| 7,404,416 | B2 | 7/2008 | Schultz et al. | |
| 7,405,998 | B2 | 7/2008 | Webb et al. | |
| 7,409,999 | B2 | 8/2008 | Henriksen et al. | |
| 7,413,010 | B2 | 8/2008 | Blauch et al. | |
| 7,537,056 | B2 | 5/2009 | MacDougall | |
| 7,775,456 | B2 | 8/2010 | Gopalan et al. | |
| 2004/0256099 | A1 | 12/2004 | Nguyen et al. | |
| 2007/0045038 | A1 | 3/2007 | Han et al. | |
| 2007/0256828 | A1 | 11/2007 | Birchak et al. | |
| 2008/0041580 | A1 | 2/2008 | Freyer et al. | |
| 2008/0041581 | A1 | 2/2008 | Richards | |
| 2008/0041582 | A1 | 2/2008 | Saetre et al. | |
| 2008/0041588 | A1 | 2/2008 | Richards et al. | |
| 2008/0149323 | A1 | 6/2008 | O'Malley et al. | |
| 2008/0283238 | A1 | 11/2008 | Richards et al. | |
| 2009/0008088 | A1 | 1/2009 | Schultz et al. | |
| 2009/0008090 | A1 | 1/2009 | Schultz et al. | |
| 2009/0009297 | A1 | 1/2009 | Shinohara et al. | |
| 2009/0009333 | A1 | 1/2009 | Bhogal et al. | |
| 2009/0009336 | A1 | 1/2009 | Ishikawa | |
| 2009/0009412 | A1 | 1/2009 | Warther | |
| 2009/0009437 | A1 | 1/2009 | Hwang et al. | |
| 2009/0009445 | A1 | 1/2009 | Lee | |
| 2009/0009447 | A1 | 1/2009 | Naka et al. | |
| 2009/0078427 | A1 | 3/2009 | Patel | |
| 2009/0078428 | A1 | 3/2009 | Ali | |
| 2009/0101354 | A1 | 4/2009 | Holmes et al. | |
| 2009/0133869 | A1 | 5/2009 | Clem | |
| 2009/0151925 | A1 | 6/2009 | Richards et al. | |
| 2009/0159282 | A1 | 6/2009 | Webb et al. | |
| 2009/0250224 | A1 | 10/2009 | Wright et al. | |
| 2009/0277639 | A1 | 11/2009 | Schultz et al. | |
| 2009/0277650 | A1 | 11/2009 | Casciaro et al. | |
| 2010/0101773 | A1 | 4/2010 | Nguyen et al. | |
| 2011/0042092 | A1 | 2/2011 | Fripp et al. | |

FOREIGN PATENT DOCUMENTS

| | | | |
|---|---|---|---|
| GB | 2423157 | A | 8/2006 |
| WO | 2002014647 | A1 | 2/2002 |
| WO | 2003062597 | A1 | 7/2003 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |

OTHER PUBLICATIONS

Liao, Rongqing; Wu, Jiang; JUVKAM-WOLD H.C.; "New Nozzel to Increase Drilling Rate by Pulsating Jet Flow", conference paper for the IADC/SPE Drilling conference, SPE 27468, dated Feb. 15-18, 1994, 9 pages.

Gupta, A.; Summers, D.A.; CHACKO; "Feasibility of Fluid-Jet Based Drilling Methods for Drilling Through Unstable Formations", conference paper for the SPE/PS-CIM/CHOA International Thermal Operations and Heavy Oil and International Horizontal Well Technology Conference, SPE 78951, dated Nov. 4-7, 2002, 6 pages.

Pierce, K.G.; Livesay, B.J.; Finger, J.T.; "Advanced Drilling Systems Study", report paper for Natural Gas Technology Branch and Geothermal Division of the U.S. Department of Energy, SAND95-0331, dated Jun. 1996, 163 pages.

IP.COM; "Apparatus and Method of Inducing Fluidic Oscillation in a Rotating Cleaning Nozzle", Technical Disclosure, dated Apr. 24, 2007, 4 pages.

IP.COM; "Apparatus and Method for Stimulation Using a PumpDown/Retrievalable Cleaning Tool", Technical Disclosure, dated Jun. 13, 2007, 6 pages.

Cohen, J.H.; Deskins, G.; Rogers, J.; "High-Pressure Jet Kerf Drilling Shows Significant Potential to Increase ROP", conference paper for the 2005 SPE Annual Technical Conference, SPE 96557, dated Oct. 9-12, 2005, 8 pages.

Kolle, J.J.; "A Comparison of Water Jet, Abrasive Jet and Rotary Diamond Drilling in Hard Rock", Tempress Technology paper, dated 1999, 8 pages.

Halliburton; "Pulsonix TF Service", informational brochure, H05026, dated Mar. 2011, 2 pages.

Halliburton; "EquiFlow Inflow Control Devices", informational brochure, H05600, dated Oct. 2009, 2 pages.

Halliburton; "EquiFlow Inject System", informational brochure, H07009, Sep. 2009, 2 pages.

Halliburton; "Simulation Software for EquiFlow ICD Completions", H07010, Sep. 2009, 2 pages.

Halliburton; "Highly Durable Premium Drill Bits", informational brochure, H07259, Dec. 2009, 2 pages.

Halliburton; "EquiFlow Sliding Side-Door Inflow Control Device", informational brochure, H08626, Aug. 2011, 2 pages.

Joseph M. Kirchner, "Fluid Amplifiers", 1996, 6 pages, McGraw-Hill, New York.

Joseph M. Kirchner, et al., "Design Theory of Fluidic Components", 1975, 9 pages, Academic Press, New York.

Microsoft Corporation, "Fluidics" article, Microsoft Encarta Online Encyclopedia, copyright 1997-2009, 1 page, USA.

The Lee Company Technical Center, "Technical Hydraulic Handbook" 11th Edition, copyright 1971-2009, 7 pages, Connecticut.

Specification and Drawings for U.S. Appl. No. 10/650,186, filed Aug. 28, 2003, 16 pages.

Apparatus and Method of Inducing Fluidic Oscillation in a Rotating Cleaning Nozzle, ip.conn, dated Apr. 24, 2007, 3 pages.

* cited by examiner

THREE DIMENSIONAL FLUIDIC JET CONTROL

BACKGROUND

This disclosure relates generally to control of fluid jets and, in an example described below, more particularly provides for three dimensional control of fluid jets via use of a fluidic circuit.

It is sometimes beneficial to use fluid jets in well operations. However, in order to cover a three-dimensional volume with a fluid jet, such fluid jets have been rotated, indexed with mechanisms having moving parts, etc.

Therefore, it will be appreciated that improvements would be beneficial in the art of directionally controlling fluid jets. Such improvements would also find use in operations other than well operations.

SUMMARY

In the disclosure below, a jetting device and associated methods are provided which bring improvements to the art. One example is described below in which a fluid jet is discharged from the jetting device in three dimensions, without rotation of any components of the jetting device, and without use of any moving parts. Another example is described below in which an improved jetting device is used to drill a wellbore.

In one aspect, a jetting device is provided to the art by the disclosure below. The jetting device can include a body having at least one outlet, and a fluidic circuit which directs a fluid jet to flow from the outlet in multiple non-coplanar directions, without rotation of the outlet.

In another aspect, a method of controlling a fluid jet is described below. The method can include discharging fluid through an outlet of a jetting device, thereby causing the fluid jet to be flowed in multiple non-coplanar directions. The fluid jet is directed in the non-coplanar directions by a fluidic circuit of the jetting device.

In yet another aspect, a method of drilling a wellbore is provided. The method can include flowing fluid through a fluidic switch of a jetting device, thereby causing a fluid jet to be discharged in multiple non-coplanar directions from the jetting device, and the fluid jet cutting into an earth formation.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
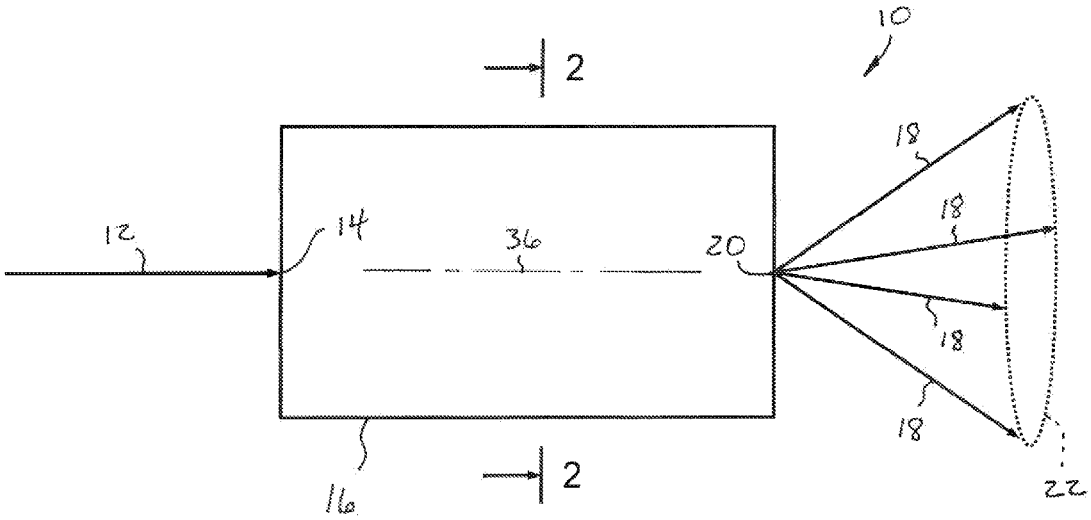
FIG. 1 is a representative partially cross-sectional view of a jetting device and associated method which can embody principles of this disclosure.

Representatively illustrated in FIG. 1 is a jetting device 10 and associated method which can embody principles of this disclosure. As depicted in FIG. 1, a fluid 12 flows into an inlet 14 of a body 16, and a fluid jet 18 is discharged in multiple non-coplanar directions from an outlet 20.

The fluid jet 18 is illustrated in FIG. 1 as being discharged in multiple directions from the outlet 20. In an example described below, the fluid jet 18 is not simultaneously discharged from the outlet 20 in the multiple directions, but is instead flowed in the multiple directions in succession. However, in other examples, the fluid jet 18 could be flowed from the outlet 20 in multiple directions simultaneously, if desired.

Although only a single outlet 20 is depicted in FIG. 1, any number of outlets may be provided. For example, a separate outlet could be provided for each of the multiple directions in which the fluid jet 18 is to be directed, etc.

Although only a single fluid 12, a single body 16 and a single inlet 14 are depicted in FIG. 1, any number of these components may be provided. For example, the body 16 could comprise multiple body sections, multiple inlets could be formed in the body, multiple fluids (such as a carrier fluid and an abrasive slurry, etc.) could be mixed in the body, etc.

The fluid 12 may or may not be in jet form when it enters the body 16. For example, the fluid jet 18 could be formed from the fluid 12 in the body, or the fluid 12 could be in jet form prior to flowing into the body, etc.

Preferably, the fluid 12 is in jet form (as fluid jet 18) when it is discharged from the outlet 20. In an example described below, the fluid jet 18 is formed prior to the fluid 12 flowing through a fluidic switch 32 in the body 16.

As depicted in FIG. 1, the multiple directions of the fluid jet 18 circumscribes a circular periphery 22. In other examples, the fluid jet 18 could be discharged in directions defined by elliptical, oval, rectangular, polygonal, non-circular or other periphery shapes. Furthermore, note that it is not necessary for the directions of the fluid jet 18 to circumscribe a periphery, or any particular periphery, in keeping with the principles of this disclosure. For example, the fluid jet 18 could be discharged in any non-coplanar directions, including directions which do not circumscribe any particular periphery.

Figure 2:
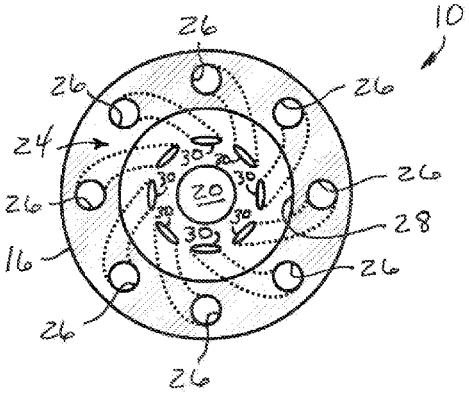
FIG. 2 is a representative cross-sectional view of the jetting device, taken along line 2-2 of FIG. 1.

Referring additionally now to FIG. 2, a cross-sectional view of the jetting device 10 is representatively illustrated. In this view, it may be seen that a fluidic circuit 24 is disposed in the body 16. In this example, the fluidic circuit 24 comprises multiple feedback flow paths 26 formed in the body 16 circumscribing a central chamber 28. The feedback flow paths 26 are connected to the chamber 28 via respective ports 30.

In this example, the feedback flow paths 26 extend generally helically in the body 16. However, in other examples the feedback flow paths 26 could extend in other ways through the body 16 (e.g., linearly, non-helically, etc.).

Note that the ports 30 connect the feedback flow paths 26 to the chamber 28 somewhat upstream of the outlet 20. As described more fully below, a portion of the fluid 12 which flows toward the outlet 20 is diverted into successive ones of the feedback flow paths 26, so that the fluid portions which flow through the feedback flow paths are directed to a fluidic switch of the circuit 24.

Figure 3:
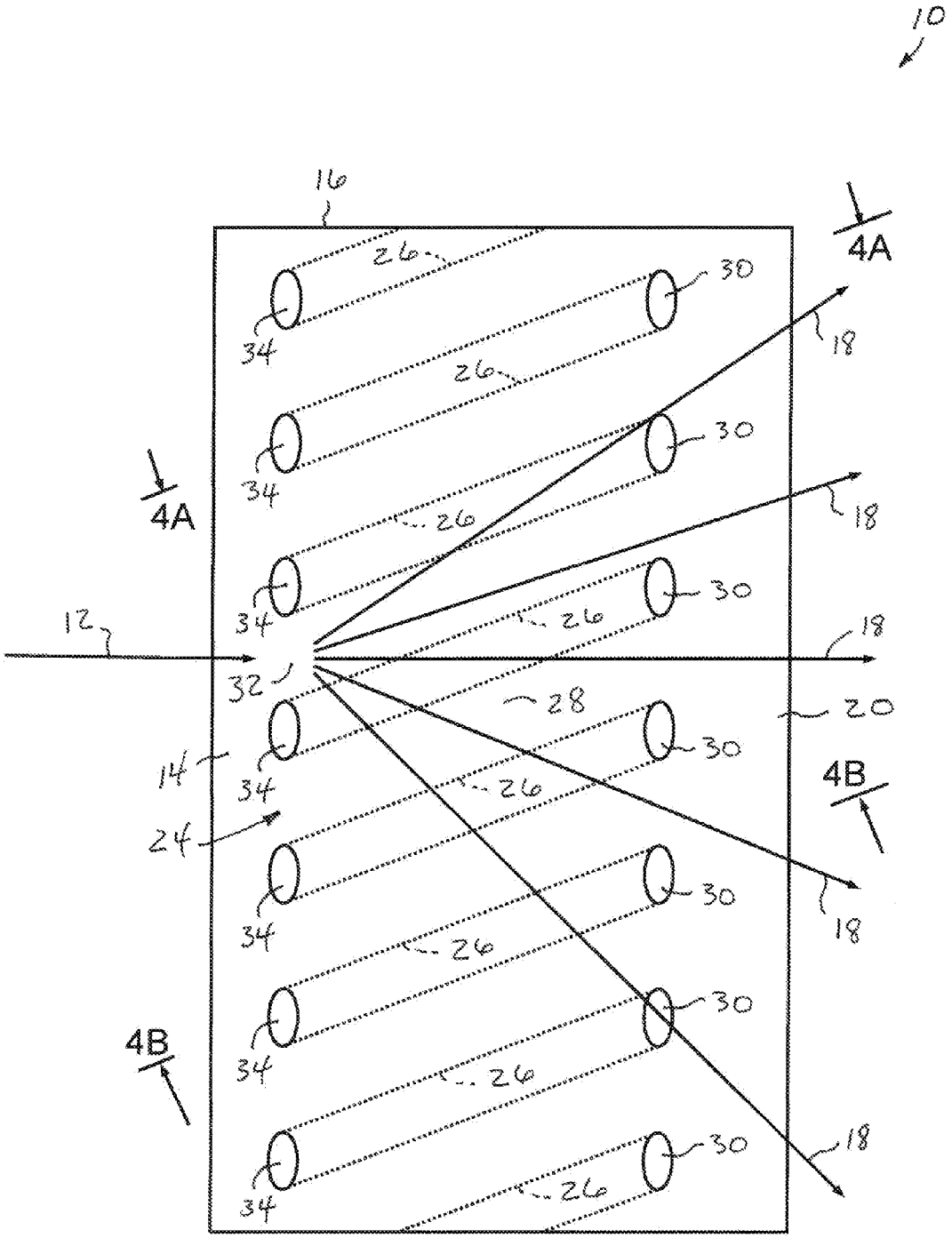
FIG. 3 is a representative "unrolled" interior view of the jetting device.

Referring additionally now to FIG. 3, an enlarged scale "unrolled" interior view of the jetting device 10 is representatively illustrated. This view depicts the jetting device 10 as if the body 16 had been split on one side and rolled flat.

As illustrated in FIG. 3, the fluid 12 flows into the inlet 14 on the left-hand side of the body 16, and is discharged from the outlet 20 on the right-hand side of the body. The fluid 12 is deflected in a succession of directions by a fluidic switch 32 of the fluidic circuit 24.

The feedback flow paths 26 are connected to the fluidic switch 32 via respective control ports 34. Note that one result of the feedback flow paths 26 being helically formed in the body 16 is that the portion of the fluid 12 which flows into one of the ports 30 in a corresponding direction will exit one of the control ports 34 in a direction which is oblique relative to a central longitudinal axis 36 (see FIG. 4) of the chamber 28. The direction of flow of the fluid 12 portion will be rotated about the axis 36 by an angle corresponding to the helical rotation of the feedback flow paths 26 between the ports 30 and the control ports 34.

Another result of the helical shape of the feedback flow paths 26 is that the feedback flow paths are not coplanar with each other. As described more fully below, this non-coplanar characteristic provides for deflection of the fluid 12 in multiple non-coplanar directions.

Note that the FIG. 2 illustration of the jetting device 10 depicts eight each of the feedback flow paths 26 and ports 30, whereas the FIG. 3 illustration of the jetting device depicts seven each of the feedback flow paths, ports and control ports 34. This demonstrates that any number of the components of the fluidic circuit 24 may be used, in keeping with the scope of this disclosure. Preferably, at least three of the feedback flow paths 26, ports 30 and control ports 34 are used in the fluidic circuit 24 to achieve a sequential indexing of flow through each set of respective feedback flow paths, ports and control ports in succession.

Figure 4:
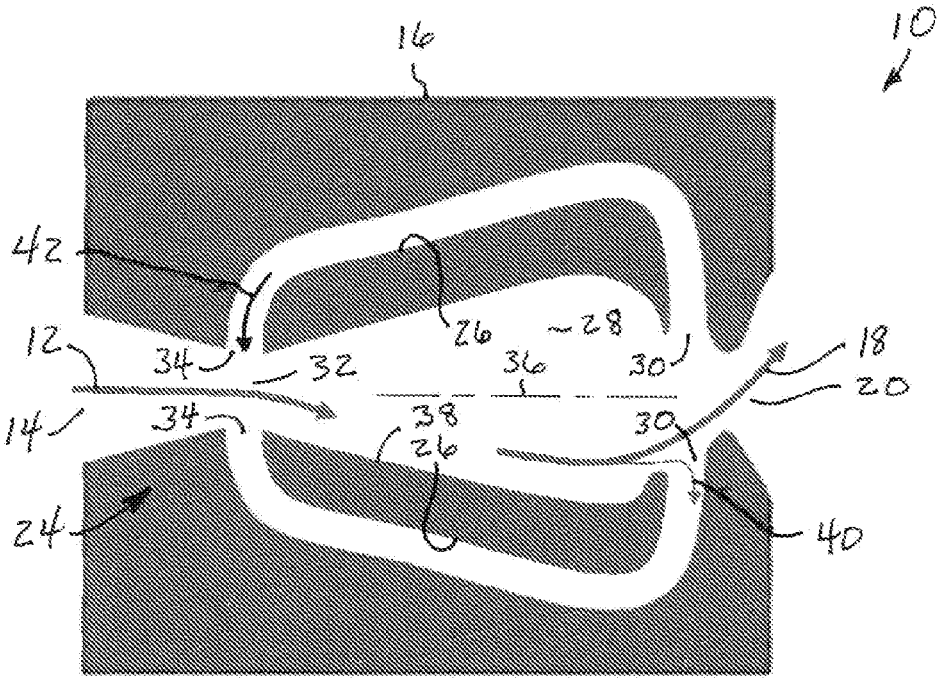
FIG. 4 is a representative cross-sectional view of the jetting device, taken along lines 4A-4A and 4B-4B of FIG. 3.

Referring additionally now to FIG. 4, a cross-sectional view of the jetting device 10 is representatively illustrated. An upper part of FIG. 4 (above the axis 36) depicts a section of the jetting device 10 taken along line 4A-4A of FIG. 3, and a lower part of FIG. 4 depicts a section of the jetting device taken along line 4B-4B of FIG. 3, it being understood that these sections are not actually coplanar in the jetting device of FIG. 3.

As illustrated in FIG. 4, the fluid 12 enters the inlet 14 of the fluidic circuit 24. In this example, a flow area is reduced downstream of the inlet 14. If the fluid 12 is not already in jet form, this reduction in flow area can result in the fluid jet 18 being formed.

The fluid 12 next flows through the fluidic switch 32. Due to the well known Coanda effect, the fluid jet 18 will tend to flow along an inner wall 38 of the chamber 28 downstream of the fluidic switch 32.

In the FIG. 4 example, the fluid jet 18 flows along the inner wall 38 to the outlet 20, from which the fluid jet is discharged in a particular direction determined by the fluid jet's path along the wall from the fluidic switch 32. As viewed in FIG. 4, the fluid jet 18 traverses a lower one of the ports 30 prior to flowing upwardly out of the outlet 20.

Figure 5:
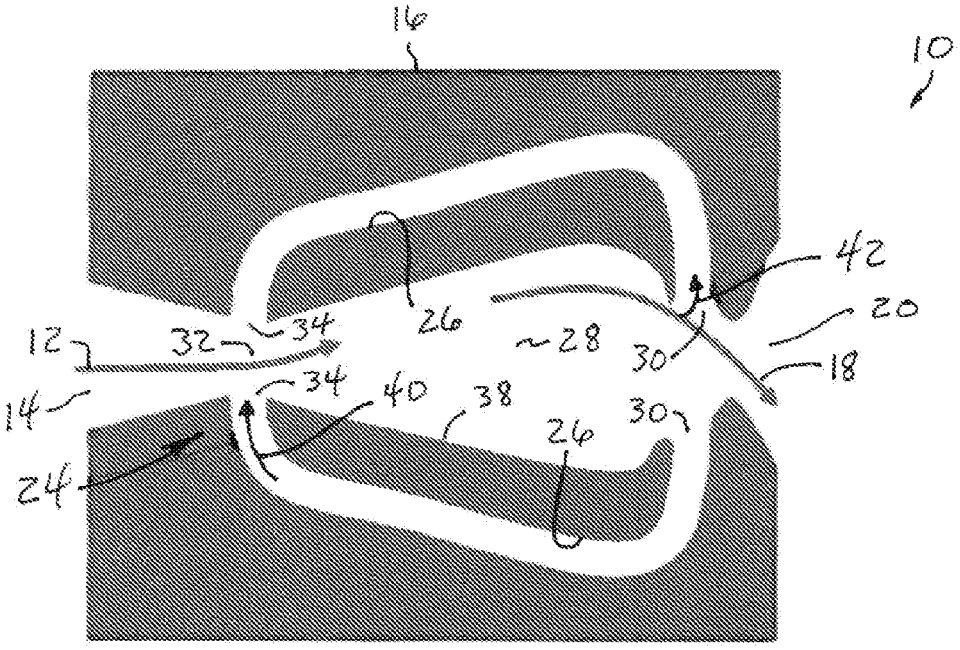
FIG. 5 is a representative cross-sectional view of the jetting device with flow of a fluid through the jetting device being deflected by a fluidic switch.

As the fluid jet 18 traverses the port 30, a portion 40 of the fluid 12 is diverted into the port. This fluid portion 40 flows through the lower feedback flow path 26 to the lower control port 34. In FIG. 5, the fluid portion 40 is depicted flowing through the lower control port 34 of the fluidic switch 32, thereby deflecting the fluid 12 upward.

As a result, the fluid jet 18 now flows along the inner wall 38 in a different direction. Since the upper and lower parts of FIGS. 4 & 5 (which depict the sections of the inner wall 38 along which the fluid jet 18 flows in this example) are non-coplanar with each other, the directions in which the fluid jet 18 are discharged from the outlet 20 in FIGS. 4 & 5 are also non-coplanar.

The fluid jet 18 as depicted in FIG. 5 traverses an upper one of the ports 30. As the fluid jet 18 traverses the upper port 30, a portion 42 of the fluid 12 is diverted into the port. This fluid portion 42 flows through the upper feedback flow path 26 to the upper control port 34.

In FIG. 4, the fluid portion 42 is depicted flowing through the upper control port 34 of the fluidic switch 32, thereby deflecting the fluid 12 downward. As a result, the fluid jet 18 now flows along the lower inner wall 38, and in a different direction from that of FIG. 5.

In this example, the difference in direction of flow of the fluid jet 18 along the inner wall 38 of the chamber 28 between FIGS. 4 & 5 is determined by the rotational offset between the ports 30 and control ports 34 connected by the respective feedback flow paths 26. Preferably, this rotational offset is selected, so that the fluid jet 18 is directed to flow along the inner wall 38 in incrementally advanced alternating directions across the chamber 28.

One way of accomplishing this result is to longitudinally align each control port 34 with a port 30 connected to an adjacent corresponding feedback flow path 26. Such an arrangement is depicted in FIG. 3, but it should be clearly understood that this arrangement is not necessary in keeping with the scope of this disclosure. In other examples, the direction of flow of the fluid jet 18 along the inner wall 38 could be changed by use of directional nozzles on the control ports 34 and/or by appropriately shaping the ports 30 and/or control ports 34 (e.g., offset, inclined and/or curved shapes, etc.), etc.

In the FIGS. 4 & 5 example, the fluid jet 18 is discharged from the outlet 20 in multiple non-coplanar directions which circumscribe the circular periphery 22 as depicted in FIG. 1. Preferably, the fluid jet 18 is discharged in each direction in succession, the order of which is determined by the arrangement of ports 30 and control ports 34 in the fluidic circuit 24. In such an arrangement, a portion of the fluid 12 will flow through each set of corresponding feedback flow path 26, port 30 and control port 34 in succession, the order of which is determined by the arrangement of ports and control ports in the fluidic circuit 24.

Note that, in the FIGS. 4 & 5 example, fluid is flowed through a feedback flow path 26 to a control port 34, thereby deflecting the fluid 12 away from that control port in the fluidic switch 32. However, in other examples, the fluid 12 could be deflected toward a control port 34 by withdrawing fluid from the corresponding feedback flow path 26, thereby creating a reduced pressure region at the control port. This could be accomplished in one example by positioning the corresponding port 30 in a relatively high velocity flow region (such as, at the reduced flow area adjacent the outlet 20), so that a venturi effect reduces pressure at the port 30, with this reduced pressure being transmitted via the corresponding feedback flow path 26 to the control port 34.

Furthermore, it should be clearly understood that it is not necessary for the fluid jet 18 to be directed in any particular directions in succession, or in any particular order. Instead, the fluid jet 18 could be directed at random. In one example, the tendency of the fluid jet 18 to flow along the inner wall 38 in a particular direction due to the Coanda effect could be destabilized, so that the fluid jet traverses the chamber 28 in random directions toward the outlet 20. Such instability could be provided, for example, by suitable design of the inner wall 38 surface, suitable design of another structure disposed in the chamber 28, etc.

Figure 6:
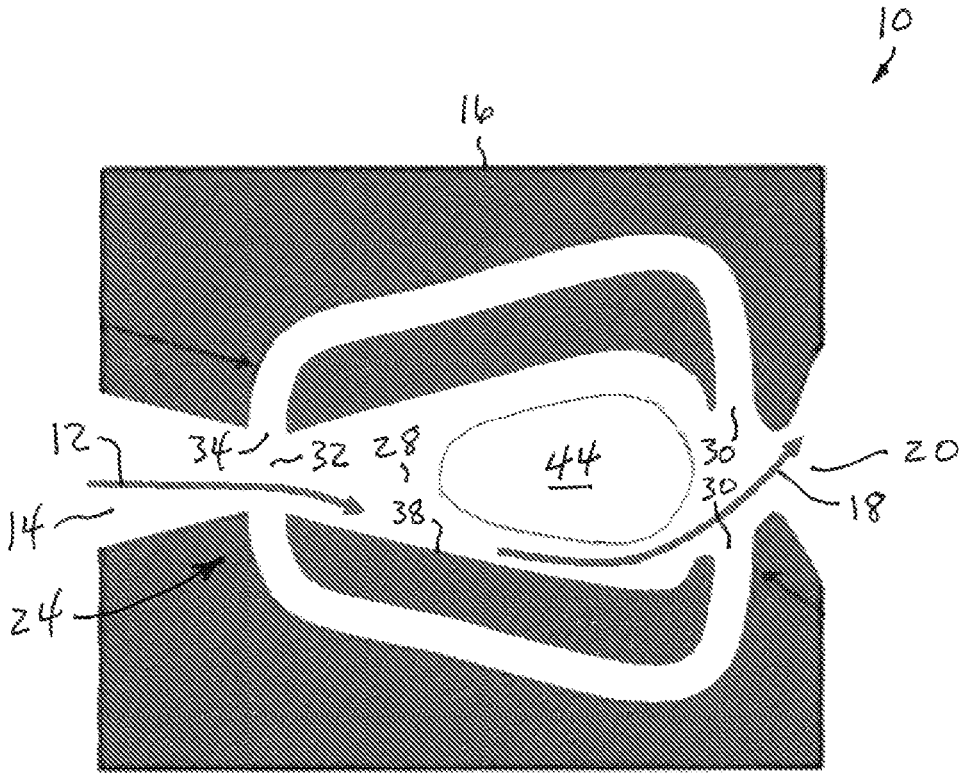
FIG. 6 is a representative cross-sectional view of another configuration of the jetting device.

Referring additionally now to FIG. 6, another configuration of the jetting device 10 is representatively illustrated. In this configuration, a structure 44 is disposed in the chamber 28. Preferably, the structure 44 functions to more advantageously control the flow of the fluid jet 18 from the chamber 28 to the outlet 20, so that the fluid jet is discharged from the outlet in more desirable condition.

However, other or different benefits may be provided by the structure 44 in keeping with the scope of this disclosure. In other examples, the structure 44 could function to change the direction of flow of the fluid jet 18 along the inner wall 38 (e.g., by use of vanes, recesses, etc.), or to accomplish any other purpose. In that case, the feedback flow paths 26 may not extend helically in the body 16, since radial offset in the flow of the fluid jet 18 between the ports 30 and control ports 34 could be provided by the structure 44.

The structure 44 could be shaped or otherwise configured to cause instability in the direction of flow of the fluid jet 18 toward the outlet 20. For example, the structure 44 could randomly disrupt the Coanda effect which influences the fluid jet 18 to flow along the inner wall 38.

Depending on the intended use of the jetting device 10, the fluid 12 could include any of a variety of different substances, combinations of substances, etc. For cutting uses, it may be desirable to include an abrasive suspended (or solids carried) in a liquid, depending on the material to be cut. For cleaning uses, it may be desirable to provide a mixture of cleaning substances (e.g., surfactants, solvents, etc.) diluted with water. Any substance, fluid (liquid and/or gas), material or combination thereof may be used for the fluid 12 in keeping with the scope of this disclosure.

In one example, steel shot could be conveyed by the fluid 12.

Figure 7:
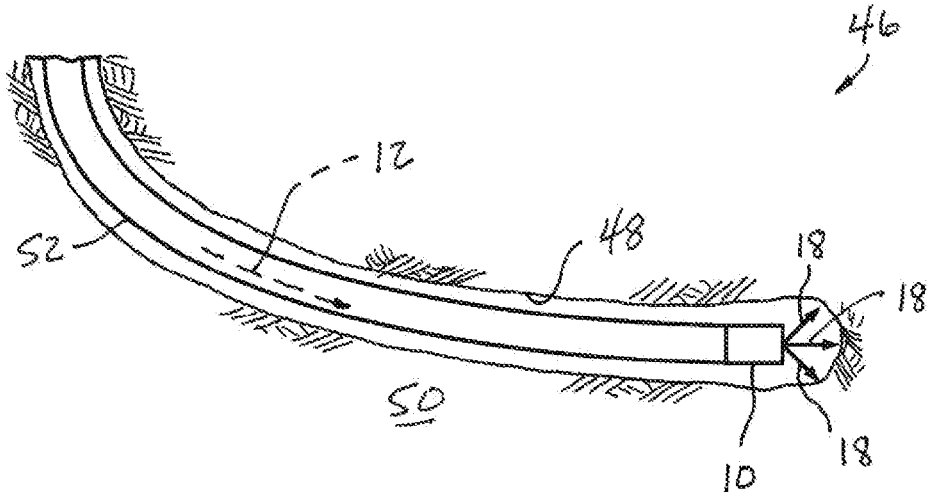
FIGS. 7-12 are representative cross-sectional views of various methods of utilizing the jetting device.

Referring additionally now to FIG. 7, a method 46 of using the jetting device 10 is representatively illustrated. In this method, the jetting tool 10 is used to drill a wellbore 48 through an earth formation 50. The fluid 12 can be flowed to the jetting device 10 through a tubular string 52 connected to the jetting device.

Since rotation of the jetting device 10 is not necessary to achieve flow of the fluid jet 18 in multiple non-coplanar directions, and since weight does not need to be applied to the tubular string 52 to achieve cutting into the formation 50, the tubular string can advantageously be a continuous tubular string (for example, a coiled tubing string, etc.), with no need to rotate the tubular string, and with no need for a mud motor or any mechanical indexing device to rotate the fluid jet 18 or any drill bit. However, in other examples, the tubular string 52 and/or the jetting device 10 may be rotated (e.g., for directional drilling, etc.), in keeping with the principles of this disclosure.

For purposes of cutting into the formation 50, the fluid 12 preferably does not include any abrasive particles therein. However, such abrasive particles could be provided, if desired.

Figure 8:
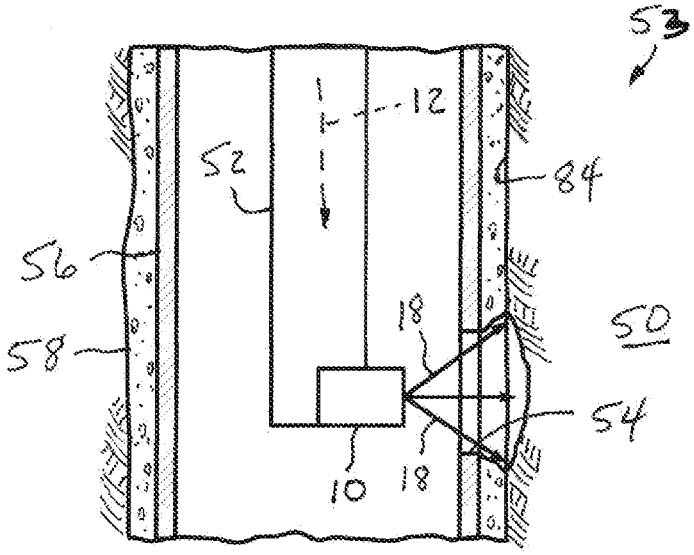

In a method 53 representatively illustrated in FIG. 8, the jetting device 10 is depicted as being used to cut a window 54 through a tubular string 56 (such as, a casing or liner string, etc.), cement 58, and into the formation 50. Such an operation could be performed, for example, to initiate drilling a lateral or branch wellbore outward from the window 54.

Figure 9:
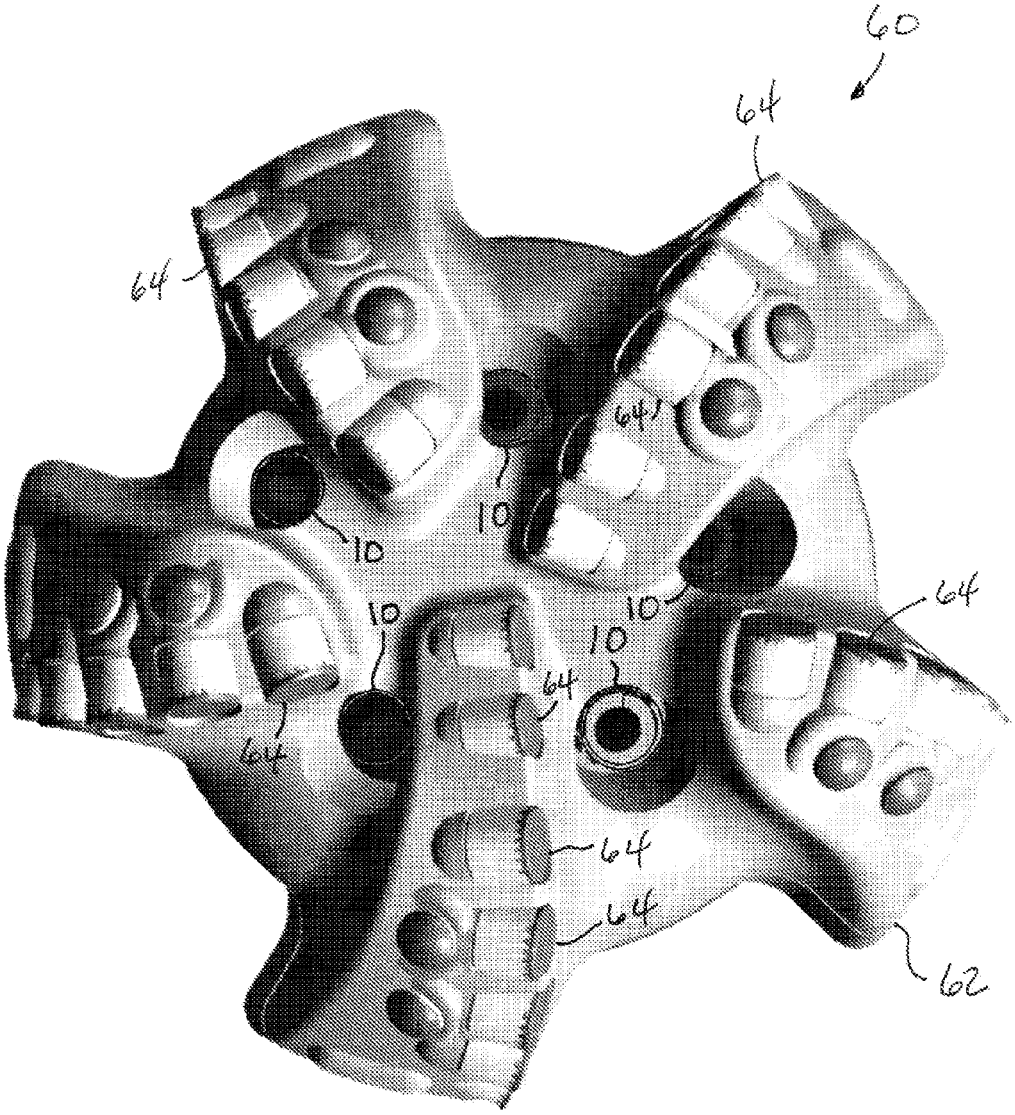

In another method 60 representatively illustrated in FIG. 9, multiple jetting devices 10 are provided in a drill bit 62 to clean cuttings from cutters 64 on the drill bit, to assist in circulating the cuttings to the surface, etc. Although fixed cutters 64 (e.g., polycrystalline diamond compact (PDC) or grit hotpressed inserts (GHI), etc.) are depicted in FIG. 9, rotary (e.g., as used on tri-cone drill bits) or other types of cutters, teeth, etc., may be used within the scope of this disclosure.

Figure 10:
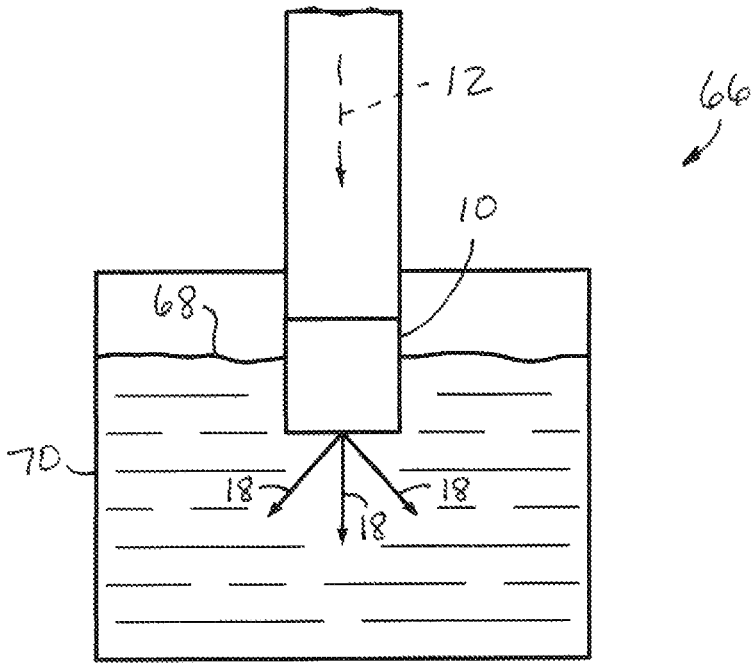

In a method 66 representatively illustrated in FIG. 10, the jetting device 10 is depicted as being used to mix the fluid 12 with another substance 68, for example, in a container 70. The fluid jets 18 disperse the fluid 12 in the substance 68 (e.g., another fluid, a gel, a powder or granular solid, etc.). Such a technique could be useful, for example, in mixing cement 58 for use in lining the wellbore 48 (e.g., as depicted in FIG. 8).

Figure 11:
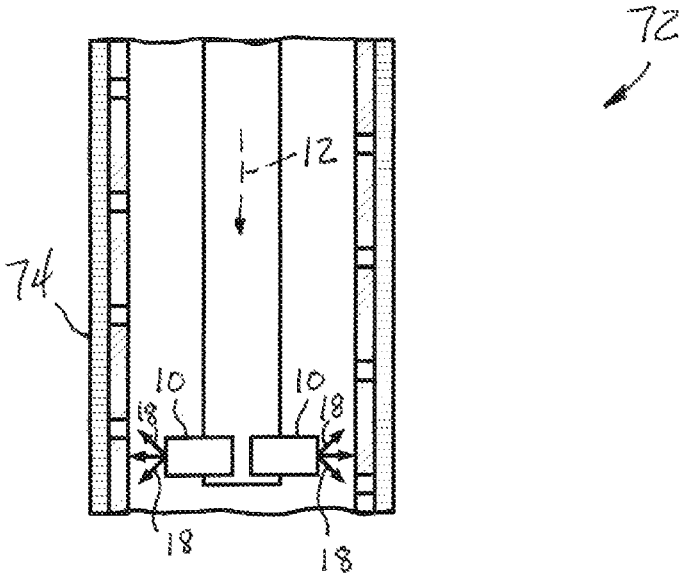

In another method 72 representatively illustrated in FIG. 11, the jetting device 10 is depicted as being used to clean a well screen 74. Such cleaning could include conditioning a gravel pack (not shown) exterior to the well screen 74.

Other structures could be cleaned using the jetting device 10. For example, scale could be cleaned from tubing, asphaltenes could be cleaned from casing, debris and mud could be cleaned from an open hole formation, etc.

Figure 12:
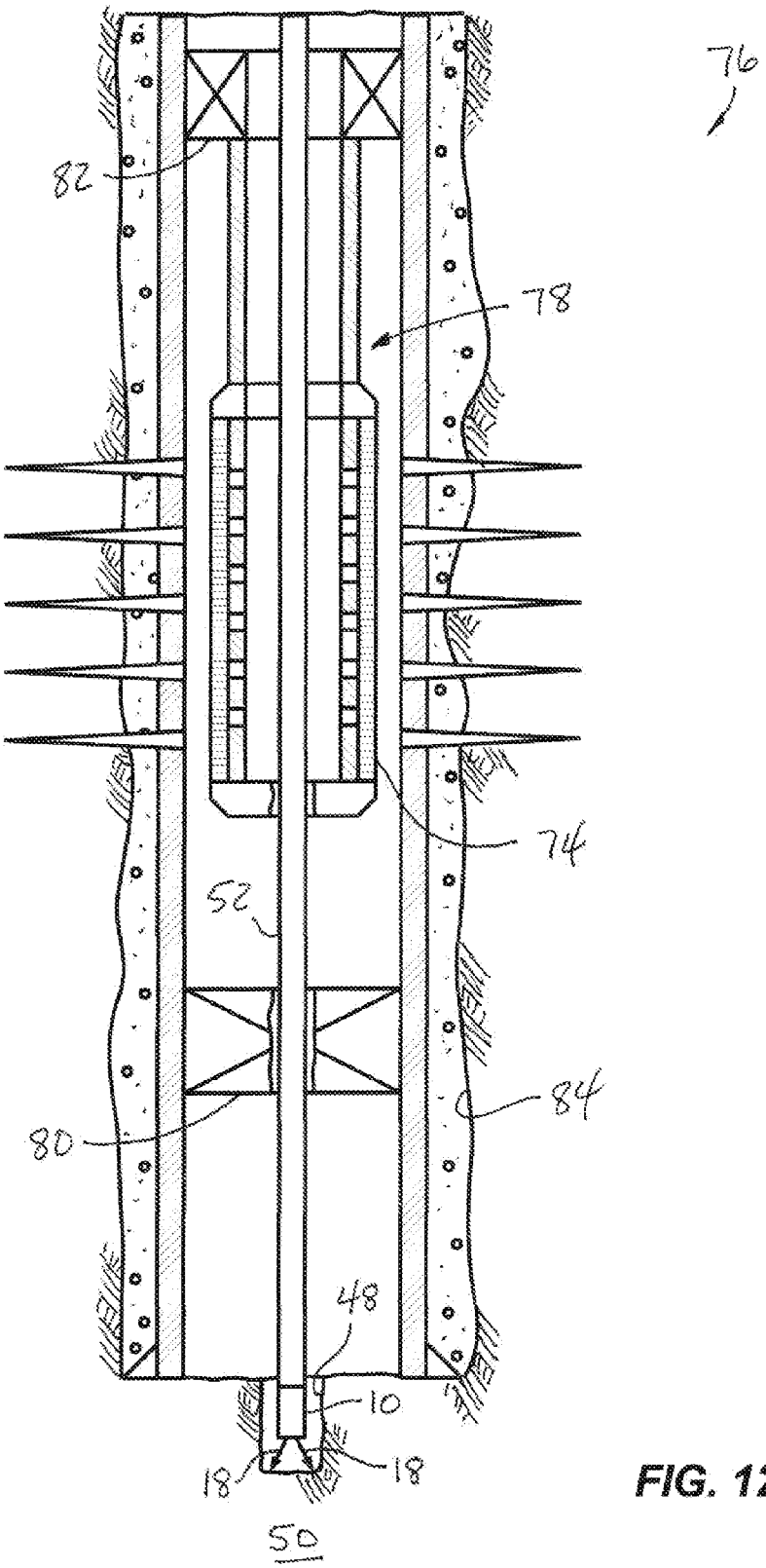

In yet another method 76 representatively illustrated in FIG. 12, the jetting device 10 is depicted as being used to cut into the formation 50 after previously having been used to cut through a completion assembly 78 and/or another structure 80 (such as a bridge plug, etc.) in a well. In this manner, the wellbore 48 can be drilled after cutting through the completion assembly 78 and/or structure 80, without a need to retrieve the completion assembly or structure from the well.

As depicted in FIG. 12, the completion assembly 78 includes a packer 82 and the well screen 74, but other components and combinations of components may be provided in the completion assembly in keeping with the scope of this disclosure. Note that abrasive particles may be included with the fluid 12 when the jetting device 10 is used to cut through metal structures, such as the tubular string 56 of FIG. 8 (although tubular strings are not necessarily metallic), the lower end of the completion assembly 78 and the structure 80 of FIG. 12 (although these components are not necessarily metallic), etc.

The methods of FIGS. 1-12 demonstrate that there are a wide variety of applications for the features of the jetting device 10, and the illustrated methods are merely particular examples of this variety of different applications. Accordingly, it should be clearly understood that the scope of this disclosure is not limited at all to the examples depicted in the drawings and/or described herein.

Instead, the principles of this disclosure have application in many other circumstances, to solve many other problems, and to achieve many other objectives. For example, the jetting device 10 could be used in industries in which operations other than well operations are performed. It is envisioned that the jetting device 10 could be used to distribute the fluid 12 for purposes such as fuel atomization, fluid dispersion/distribution, etc.

It may now be fully appreciated that the above disclosure provides several advancements to the art of directionally controlling a fluid jet 18. In examples described above, a jetting device 10 can be used to direct a fluid jet 18 in three dimensions (e.g., in directions which are not coplanar), with no moving parts. Instead, a fluidic circuit 24 including a fluidic switch 32 is used to change the direction of flow of fluid 12 through the device 10.

In one example, a method of controlling a fluid jet 18 is provided to the art by the above disclosure. The method can include discharging fluid 12 through an outlet 20 of a jetting device 10, thereby causing the fluid jet 18 to be flowed in a succession of non-coplanar directions. The fluid jet 18 may be directed in the succession of non-coplanar directions by a fluidic circuit 24 of the jetting device 10.

The fluidic circuit 24 preferably directs the fluid jet 18 to flow in the succession of non-coplanar directions without rotation of the outlet 20.

The method can include the fluid jet 18 cutting into a structure 80 in a well, cutting into an earth formation 50, cutting into cement 58 lining a wellbore, cutting into a tubular string 56, and/or cutting through a completion assembly 78 in a wellbore 84. The fluid jet 18 may cut into the earth formation 50 after cutting through the completion assembly 78. The method can include the fluid jet 18 cleaning about a drill bit cutter 64, mixing the fluid 12 with a substance 68, and/or cleaning a well screen or other well structure.

Also described above is a jetting device 10. In one example, the jetting device 10 can include a body 16 having at least one outlet 20, and a fluidic circuit 24 which directs a fluid jet 18 to flow from the outlet 20 in multiple non-coplanar directions without rotation of the outlet 20.

The fluidic circuit 24 may comprise multiple non-coplanar feedback flow paths 26. The feedback flow paths 26 may extend helically in the body 16.

The fluidic circuit 24 may comprise multiple feedback flow paths 26, and flow through the feedback flow paths 26 may deflect fluid 12 to flow in successive ones of the non-coplanar directions.

The fluidic circuit 24 may comprise a fluidic switch 32 which deflects fluid 12 to flow in successive ones of the non-coplanar directions. The fluidic circuit 24 may also comprise feedback flow paths 26 which are in communication with control ports 34 of the fluidic switch 32, whereby the fluid 12 is deflected to flow in the non-coplanar directions in response to flow through successive ones of the feedback flow paths 26.

The fluidic circuit 24 may include a structure 44 disposed within a chamber 28. The structure 44 may offset flow of the fluid jet 18 between opposite ends of multiple feedback flow paths 26.

The above disclosure also provides to the art a method of drilling a wellbore 48. In one example, the method can include flowing fluid 12 through a fluidic switch 32 of a jetting device 10, thereby causing a fluid jet 18 to be discharged from the jetting device 10 in multiple non-coplanar directions. The fluid jet 18 cuts into an earth formation 50.

The fluidic switch 32 may be connected to multiple feedback flow paths 26, and flow through a succession of the feedback flow paths 26 may direct the fluid jet 18 to flow in a succession of the non-coplanar directions.

The fluid jet 18 may flow in the multiple non-coplanar directions without rotation of the jetting device 10.

The method can include the fluid jet 18 cutting through a completion assembly 78. Cutting through the completion assembly 78 can be performed prior to cutting into the earth formation 50.

The method can include the fluid jet 18 cutting into a tubular string 56. Cutting into the tubular string 56 may be performed prior to cutting into the earth formation 50.

The method can include the fluid jet 18 cutting into cement 58. Cutting into the cement 58 may be performed prior to cutting into the earth formation 50.

Although the specific examples depicted in the drawings have feedback flow paths 26 which extend generally helically in the body 16, this is not necessary in other examples that are within the scope of this disclosure. Other ways of changing the direction of flow of the portion of the fluid 12 diverted into the feedback flow paths 26 in the jetting device 10 could be provided instead of, or in addition to, the helical shape of the feedback flow paths. For example, either of the ports 30, 34 could be shaped (e.g., offset, inclined, curved, etc.) such that the direction of flow of the portion of the fluid 12 is changed between the ports.

Note that the feedback flow paths 26 may themselves be generally planar or non-planar. For example, a helical feedback flow path 26 could be non-planar (e.g., the complete flow path does not lie in the same plane). However, a linear feedback flow path 26 would be planar.

It is to be understood that the various examples described above may be utilized in various orientations, such as inclined, inverted, horizontal, vertical, etc., and in various configurations, without departing from the principles of this disclosure. The embodiments illustrated in the drawings are depicted and described merely as examples of useful applications of the principles of the disclosure, which are not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of this disclosure. Accordingly, the foregoing detailed description is to be clearly understood as being given by way of illustration and example only, the spirit and scope of the invention being limited solely by the appended claims and their equivalents.

What is claimed is:

1. A method of controlling a fluid jet, the method comprising:

discharging fluid through an outlet of a chamber of a jetting device, thereby causing the fluid jet to be flowed in multiple non-coplanar directions, wherein the fluid jet is directed in the multiple non-coplanar directions by a fluidic circuit of the jetting device, wherein the fluidic circuit comprises multiple feedback flow paths which are non-coplanar with each other, and wherein each of the multiple feedback paths permit fluid flow from the outlet to an inlet of the chamber.

2. The method of claim 1, wherein the fluidic circuit directs the fluid jet to flow in the multiple non-coplanar directions without rotation of the outlet.

3. The method of claim 1, further comprising the fluid jet cutting into a structure in a well.

4. The method of claim 1, further comprising the fluid jet cutting into an earth formation.

5. The method of claim 1, further comprising the fluid jet cutting into cement lining a wellbore.

6. The method of claim 1, further comprising the fluid jet cutting into a tubular string.

7. The method of claim 1, further comprising the fluid jet cutting through a completion assembly in a wellbore.

8. The method of claim 7, further comprising the fluid jet cutting into an earth formation after cutting through the completion assembly.

9. The method of claim 1, further comprising the fluid jet cleaning about a drill bit cutter.

10. The method of claim 1, further comprising the fluid jet mixing the fluid with a substance.

11. The method of claim 1, further comprising the fluid jet cleaning a well structure.

12. The method of claim 11, wherein the structure comprises a well screen.

13. The method of claim 1, wherein the fluidic circuit directs the fluid to flow in the multiple non-coplanar directions in succession.

14. A jetting device, comprising:

a body having a chamber with at least one outlet; and a fluidic circuit which directs a fluid jet to flow from the outlet in multiple non-coplanar directions without rotation of the outlet, the fluidic circuit comprising multiple feedback flow paths which are non-coplanar with each other, wherein each of the multiple feedback paths permit fluid communication from the outlet of the chamber to an inlet of the chamber.

15. The jetting device of claim 14, wherein the feedback flow paths extend helically in the body.

16. The jetting device of claim 14, wherein flow through the feedback flow paths deflects fluid to flow in successive ones of the non-coplanar directions.

17. The jetting device of claim 14, wherein the fluidic circuit comprises a fluidic switch which deflects fluid to flow in successive ones of the non-coplanar directions.

18. The jetting device of claim 17, wherein the feedback flow paths are in communication with control ports of the fluidic switch, whereby the fluid is deflected to flow in the non-coplanar directions in response to flow through successive ones of the feedback flow paths.

19. The jetting device of claim 14, wherein the fluidic circuit includes a structure disposed within the chamber, and wherein the structure offsets flow of the fluid jet between opposite ends of multiple feedback flow paths.

20. A method of drilling a wellbore, the method comprising:

flowing fluid through a fluidic switch of a jetting device, thereby causing a fluid jet to be discharged from the jetting device in multiple non-coplanar directions, wherein the fluidic switch is connected to multiple feedback flow paths which are non-coplanar with each other, and wherein each of the multiple feedback flow paths permit fluid flow from an outlet of the jetting device to the fluidic switch; and the fluid jet cutting into an earth formation.

21. The method of claim 20, wherein flow through a succession of the feedback flow paths directs the fluid jet to flow in a succession of the non-coplanar directions.

22. The method of claim 20, wherein the fluid jet flows in the multiple non-coplanar directions without rotation of the jetting device.

23. The method of claim 20, further comprising the fluid jet cutting through a completion assembly.

24. The method of claim 23, wherein cutting through the completion assembly is performed prior to cutting into the earth formation.

25. The method of claim 20, further comprising the fluid jet cutting into a tubular string.

26. The method of claim 25, wherein cutting into the tubular string is performed prior to cutting into the earth formation.

27. The method of claim 20, further comprising the fluid jet cutting into cement.

28. The method of claim 27, wherein the cutting into cement is performed prior to cutting into the earth formation.

29. A jetting device, comprising:

a body having at least one outlet; and a fluidic circuit which directs a fluid jet to flow from the outlet in multiple non-coplanar directions without rotation of the outlet, the fluidic circuit comprising multiple feedback flow paths which are non-coplanar with each other and which extend helically in the body.

* * * * *